US006606794B2

(12) United States Patent
Rieser

(10) Patent No.: US 6,606,794 B2
(45) Date of Patent: Aug. 19, 2003

(54) NAIL CLIPPERS

(76) Inventor: Udo Rieser, Taunusring 28, D-65205, Wiesbaden (DE)

( * ) Notice: Subject to any disclaimer, the term of this patent is extended or adjusted under 35 U.S.C. 154(b) by 0 days.

(21) Appl. No.: 09/529,821

(22) PCT Filed: Nov. 16, 1998

(86) PCT No.: PCT/EP98/07319

§ 371 (c)(1),
(2), (4) Date: Apr. 19, 2000

(87) PCT Pub. No.: WO99/26513

PCT Pub. Date: Jun. 3, 1999

(65) Prior Publication Data

US 2002/0069533 A1 Jun. 13, 2002

(30) Foreign Application Priority Data

Nov. 20, 1997 (DE) ..... 197 51 561

(51) Int. Cl.[7] ..... A45D 29/02

(52) U.S. Cl. ..... 30/28; 30/191; 30/338; 30/341

(58) Field of Search ..... 30/26, 27, 28, 30/145, 186, 191, 193, 329, 330, 334, 337, 338, 340, 341, 344, 175; 132/73, 73.5, 75.5; D28/60

(56) References Cited

U.S. PATENT DOCUMENTS 244,891 A * 7/1881 Heim et al. ..... 30/28
639,377 A * 12/1899 Grant ..... 30/191
797,937 A * 8/1905 Carter ..... 30/28
806,037 A * 11/1905 Wilcox ..... 30/28
898,808 A * 9/1908 Wilcox ..... 30/28 X
1,721,415 A 7/1929 Schnefel
5,331,739 A * 7/1994 Basangy ..... 30/28

FOREIGN PATENT DOCUMENTS

| | | |
|---|---|---|
| DE | 478585 | 6/1929 |
| DE | 3043552 | 8/1981 |
| FR | 996752 | 12/1951 |

* cited by examiner

*Primary Examiner*—Boyer D. Ashley
(74) *Attorney, Agent, or Firm*—Milde & Hoffberg, LLP

(57) ABSTRACT

The inventive nail clippers comprise a two-membered clipper body (2) with a metal fitting (8) placed inside. The metal fitting has a U-shaped spring section (46) that, at the end of each of its legs (48), has bent portions (50) which form the cutting edges (10). The two clipper body members (4,6) also have angled portions (64,66) which encompass the leg ends of the spring section and which meet together opposite to the bent portions (50) that form the cutting edges (10). The angled portions engage with each other in such a way that they fit together, thereby ensuring that the cutting edges are accurately guided when they meet, even when the clipper body is made of plastic and is thus relatively resilient.

11 Claims, 3 Drawing Sheets

NAIL CLIPPERS

This application is a 371 of PCT/EP98/07319 filed Nov. 16, 1998.

This application relates to nail clippers designed for manicures and pedicures. More specifically, this application relates to an improved nail clipper wherein the body of the apparatus can be manufactured out of a flexible, synthetic material, without causing the separate clipping portion of the apparatus to lose its precision and proper clipping quality.

BACKGROUND OF THE INVENTION

Similar nail clippers are known from the French Pat. No. 996,752 and, in the form of so-called nail snippers from the German Pat. No. 478,585 and U.S. Pat. No. 1,721,415. In addition, it is already known, for example, from the German Pat. No. 3,043,552, to manufacture the body of nail clippers of synthetic material in order to save manufacturing costs and to use separate metal fittings embedded in the two members of the clipper body. However, synthetic material of a suitable toughness is relatively flexible in comparison to typically employed metallic materials. In addition, the cutting edges meeting each other in a line-shaped manner may not find very precise guideways in a separate clipper body, even if it is made of metal, and without said guideway, a proper cut may not possible.

SUMMARY OF THE INVENTION

It is, therefore, the objective of this invention to design nail clippers so that the cutting edges can find precise guideways, at least when the edges meet, which will make the respective clippers also suitable for cutting relatively thick nails.

This objective, as well as other objectives which will become apparent from the discussion that follows, are achieved, in accordance with the present invention, by providing nail clippers wherein the two members of the clipper body are provided with deflections which outwardly surround the two ends of the legs of the spring section such that they meet on the side opposite to the deflections which form the cutting edges and wherein, at the same time, they fittingly engage each other.

The engagement of the bent segments at the members of the clipper body that enclose the ends of the members of the spring section inevitably produces a precise guideway when the cutting edges meet. An additional improvement of the guideway is accomplished when, the two ends on the back side of the two members of the clipper body are guided in relation to one another as well.

The nail clippers can be utilized for both manicure and pedicures.

A preferred exemplary embodiment of such nail clippers is described in greater detail.

DETAILED DESCRIPTION OF THE INVENTION

Figure 2:
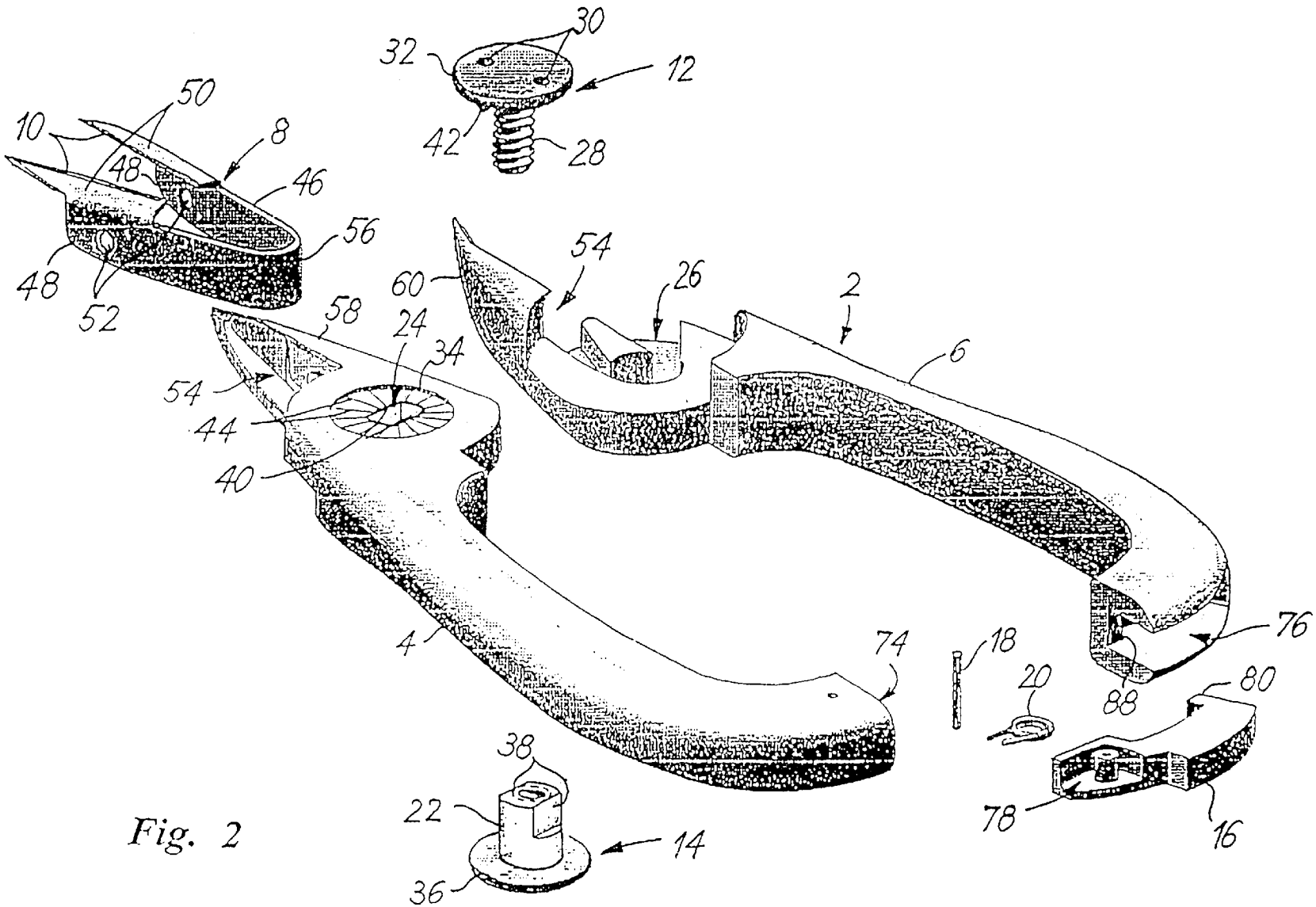
FIG. 2 shows an exploded view of the clippers, where all of its individual components can be recognized.

As can best be recognized in FIG. 2, the shown nail clippers exhibit a clipper body 2 made up of two separate members 4 and 6 of the clipper body, a metal fitting 8 with cutting edges 10 formed on the fitting, a two-member physical pivot consisting of a screw 12 and a nut 14 as well as a lock with a catch 16, an axis bolt 18 and a helical torsion spring 20.

The two members 4 and 6 of the clipper body can be joined using the screw 12 and the nut 14 by inserting the nut 14, which is provided with a shaft section 22, into corresponding holes 24 or 26 of the respective members 4 and 6 of the clipper body, with the members being placed on top of one another and then fastened with the screw 12 that is screwed in from the other side.

As can be noticed, in addition to the thread section 28, the screw 12 exhibits a flat head 32 that is provided with two holes 30, where said flat head is positioned in a corresponding recess 34 of member 4 of the clipper body. Similarly, in addition to its shaft section 22, the nut 14 exhibits a flat head 36 that is positioned in a corresponding recess (not visible in the figure) of member 6 of the clipper body.

To lock the screw 12 in relation to the nut 14, the shaft section 22 of the nut 14 has two flat sections 38 opposite to one another in its outer end section, where the flat sections fit corresponding flat sections 40 in the hole 24 of member 4 of the clipper body, and where on the bottom side of the head 32 of the screw 12 a diagonal fin 42 is provided that comes to rest in one of a multitude of grooves 44 at the bottom of the recess 34. Of course, in deviation from this embodiment, the nut 14 could also be integrated in member 4 of the clipper body.

The metal fitting 8, which is made of spring plate, exhibits a bow-shaped or, more precisely, a basically U-shaped spring section 46 with bent portions 50 on the ends of its members or legs 48, the bent portions being aligned with one another to form the cutting edges 10. Furthermore, the ends of the members (legs) 48 have holes 52 to fasten the fitting in the clipper body 2.

The fitting 8 is placed in a corresponding recess 54 of the clipper body 2 such that the top 56 of the spring section 46 surrounds the shaft section 22 of the nut 14. As shown, especially in FIG. 3, the respective front end sections 58 and 60 of members 4 and 6 of the clipper body are designed such that they surround the ends of members (legs) 48 of the spring section 46 on their outer side. Anchoring pins 62 located on the inner side of the end sections 58 and 60 penetrate through the holes 52 in the ends of members 48. In addition, the end sections 58 and 60 exhibit joining angled portions 64 and 66 located on the side opposite to the bent portions 50 of the fitting 8, and together with the bent portions 50 form a trap 68 for the nail and skin clippings cut off using cutting edges 10.

Figure 1:
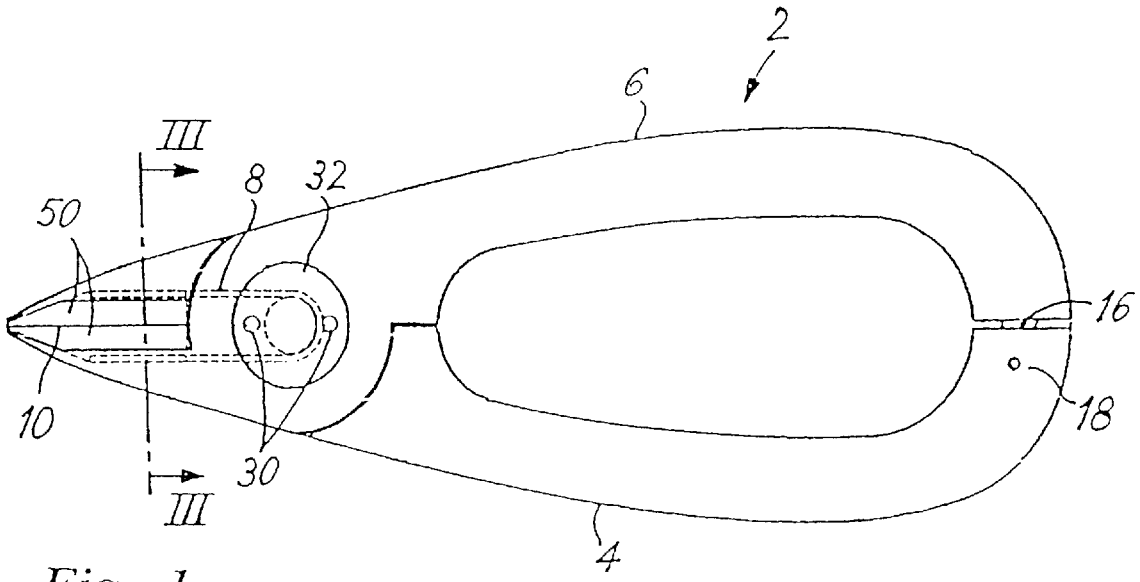
FIG. 1 shows an over-head view of the respective nail clippers in its typical size, where those portions of the metal fitting that are covered in this view are indicated by a broken line.
Figure 3:
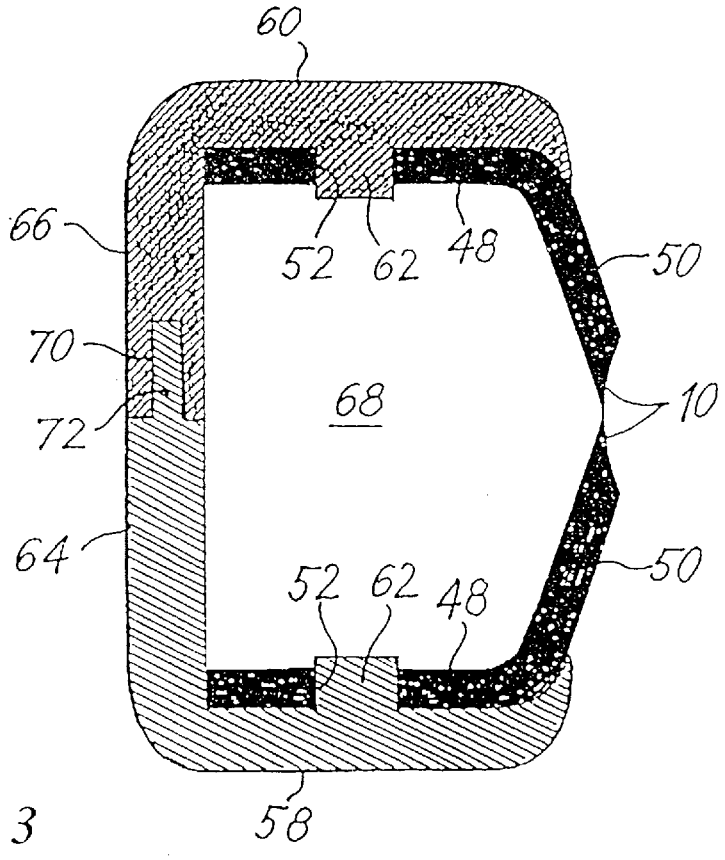
FIG. 3 shows in great magnification a section through the cutting segment of the clippers approximately along the line III—III of FIG. 1.

As can be seen from FIG. 3, angled portions 64 and 66 engage fittingly when the clippers are closed with a groove 70 and a tongue 72 in order to securely guide the end sections 58 and 60 and with them the cutting edges 10 when they meet. This is done in particular with the idea that the body 2 of the clippers is preferably made of synthetic material and, therefore, will exhibit a certain resiliency in comparison to a clipper body made of metal, which is not to be neglected.

Figure 4:
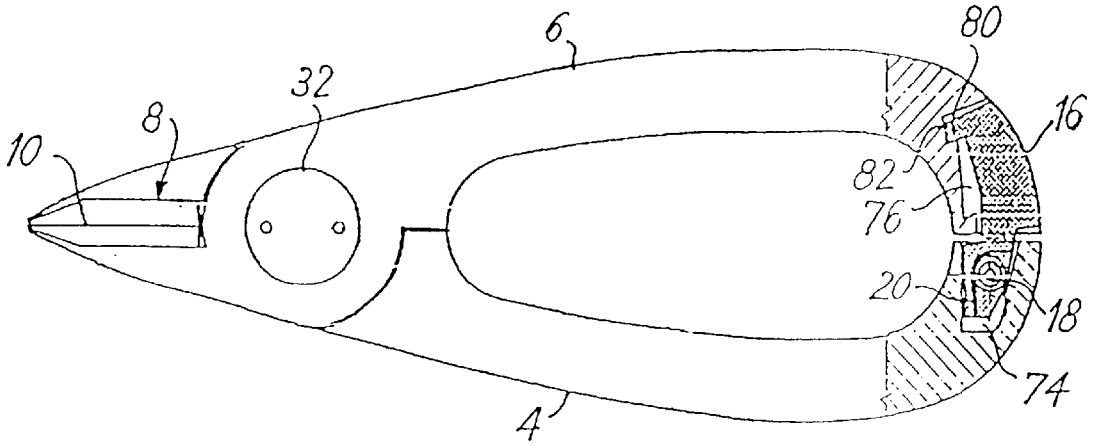
FIGS. 4, 5 and 6 each show an over-head view of the clippers, however, with the rear section, appearing cut open and where the clippers are shown in different situations of use.

The two members 4 and 6 of the clipper body receive additional reciprocal guideways by the locking mechanism mentioned above. In this instance, the catch 16 that is held in a pivoting manner by means of the axis bolt 18 in the member 4 of the clipper body, is supported appropriately on the side in respective recesses 74 or 76 (FIG. 4) of the two members 4 and 6 of the clipper body, such that the latter may not be set apart from one another.

Surrounding axis bolt 18, spring 20 is positioned in a corresponding recess 78 of the catch 16. It rests on the catch as well as on member 4 of the clipper body in a manner that is attempting to swing the catch towards the outside.

Figure 5:
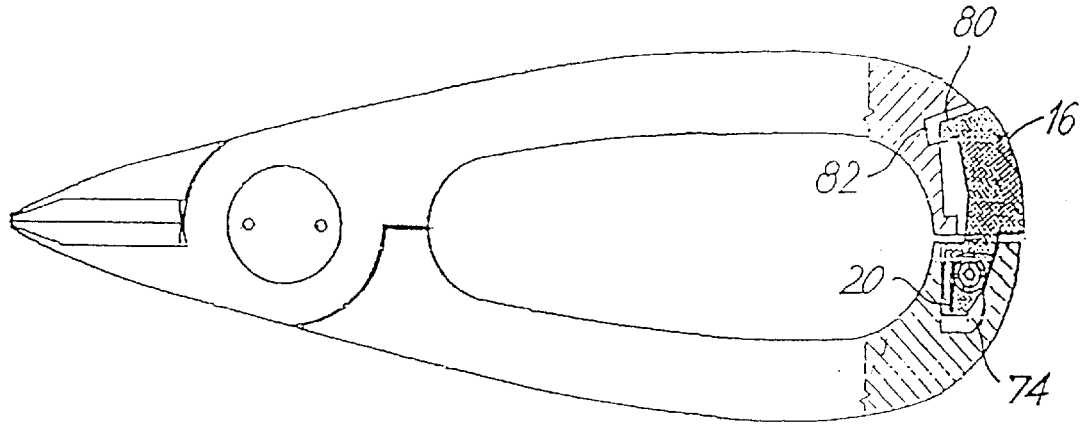
Figure 6:
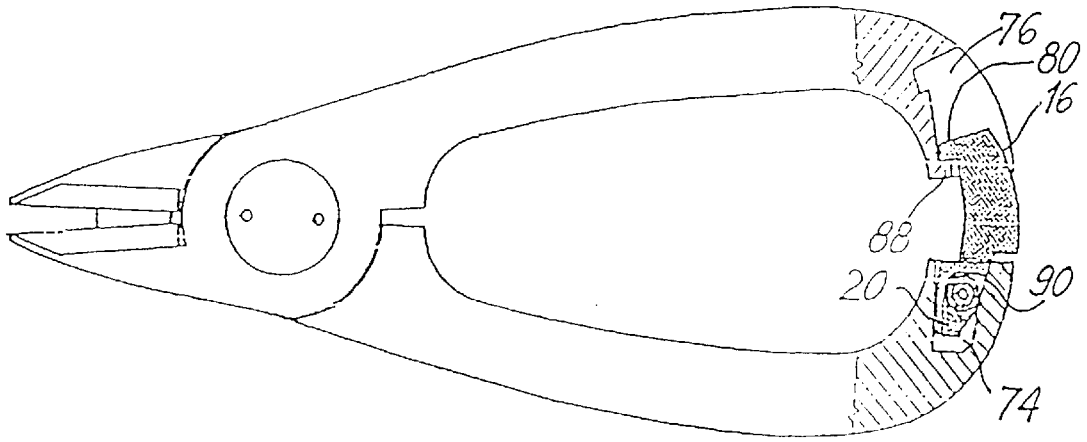

Remarkably, the catch 16 does not leave the recess 78 in member 6 of the clipper body, even when the clippers are opened as shown in FIG. 6. With fully closed clippers (FIG. 4), the catch 16 with its protrusion 80 can be pressed into an engaging indentation 82 forming an undercut at the recess 76, where it is held back due to the influence of the expansion spring force effective at the clipper body 2 on the side of the metal fitting 8. To open the clippers, initially the rear portions of members 4 and 6 of the clipper body must be pressed together slightly even further (FIG. 5), which will release the protrusion 80 from the undercut of the engaging indentation 82, and the spring 20 will swing the catch 16 outward. The spring section 46 of the metal fitting 8 will carry out the further opening. However, member 6 of the clipper body will be held back by the catch 16 in the position shown in FIG. 6, because the protrusion 80 will strike a shoulder 88 at the end of the indentation 76, while a striking surface 90 on the inside of the indentation 76 will prevent the catch 16 from swinging out further.

As can be seen in FIG. 3 as well, this makes sharpening of the cutting edges 10 easy, due to the fact that the bent portions 50 are slanted at an obtuse angle such that sharpening can be performed from the outside at the top of the slanted angle.

If the cutting edges are worn or can no longer be sharpened, the fitting 8 can be replaced easily, requiring only the loosening of screw 12 and separating the two members 4 and 6 of the clipper body.

It is understood that the clipper body 2, especially in its rear area, may be designed differently from the design presented, for example with a curve. Various deviations are also possible, for example, with regard to support and locking, if a locking mechanism is to be provided.

There has thus been shown and described a novel nail clipper which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Nail clipper with a two-member clipper body and a metal fitting inserted therein, said metal fitting including a bow-shaped spring section having two elongate legs, which spring section includes a bent portion extending longitudinally along each of said two legs and forming an angled profile in each leg with a longitudinally extending cutting edge, wherein the two members of said clipper body have longitudinal angled portions which (1) outwardly surround said two legs of said spring section, and (2), when approaching each other in the course of closing the nail clipper, overlap on a side opposite to said bent portions forming the cutting edges while at the same time fittingly engaging each other.

2. Nail clipper as set forth in claim 1, wherein the bow-shaped spring section surrounds a rotational axis of the clipper body forming a pivot for the two members.

3. Nail clipper as set forth in claim 1, wherein the bent portions of the spring section that form the cutting edges are slanted at an obtuse angle defining a central apex and wherein the cutting edges are accessible for grinding from outside of the clippers at the apex of the angle.

4. Nail clipper as set forth in claim 1, wherein the ends of the legs of the spring section are supported by end portions of the members of the clipper body and anchoring pins that penetrate through respective openings in these ends of the legs.

5. Nail clipper as set forth in claim 1, wherein the angled portions on the outside of the end portions of the members of the clipper body that surround the ends of the legs of the spring sections, together with the bent portions forming the cutting edges of the spring section, form a trap for the respective nail and skin clippings.

6. Nail clipper as set forth in claim 1, wherein the members of the clipper body are made of a plastic material.

7. Nail clipper set forth in claim 6, wherein all components of the clipper body, with the exception of the spring section, are made of a plastic material.

8. Nail clipper as set forth in claim 1, wherein the two-member clipper body includes a releasable locking mechanism that is capable of keeping the clippers at least approximately closed against the opening force of the bow-shaped spring section of the metal fitting.

9. Nail clipper as set forth in claim 8, wherein the locking mechanism comprises a catch supported in a pivoting manner by one member of the clipper body, and wherein said catch is received in a corresponding recess of the other member of the clipper body in such a manner that the two members of the clipper body remain aligned to one another when near the closed position.

10. Nail clipper as set forth in claim 9, wherein the catch is retained in the respective recess even when the clippers are open.

11. Nail clipper as set forth in claim 9, wherein, in the closed position of the clippers, the catch is pressed into an undercut of an engaging indent with a spring force tending to push it out.

* * * * *